US005425497A

United States Patent [19]

Sorensen

[11] Patent Number: 5,425,497

[45] Date of Patent: Jun. 20, 1995

[54] CUP HOLDER

[76] Inventor: Jay Sorensen, 3616 NE. Alberta Ct., Portland, Oreg. 97211

[21] Appl. No.: 150,682

[22] Filed: Nov. 9, 1993

[51] Int. Cl.[6] ..... B65D 3/22

[52] U.S. Cl. ..... 220/738; 220/903; 294/31.2

[58] Field of Search ..... 294/27.1, 31.2, 33, 294/149, 152; 220/710.5, 753, 758, 759, 412, 738, 739, 903; 229/1.5 B, 1.5 H, 89, 90

[56] References Cited

U.S. PATENT DOCUMENTS 1,632,347 6/1927 Pipkin .
1,771,765 7/1930 Benson .
1,866,805 7/1932 Haywood ..... 294/31.2
2,028,566 1/1936 Seipel et al. .
2,266,828 12/1941 Sykes .
2,591,578 4/1952 McNealy et al. .
2,617,549 11/1952 Egger .
2,661,889 12/1953 Phinney .
2,675,954 4/1954 Vogel .
2,853,222 9/1958 Gallagher .
2,979,301 4/1961 Reveal ..... 229/1.5 H X
3,049,277 8/1962 Shappell .
3,123,273 3/1964 Miller ..... 229/1.5 B
3,157,335 11/1964 Maier ..... 229/1.5 B
3,908,523 9/1975 Shikaya .
4,685,583 8/1987 Noon ..... 294/31.2 X
5,092,485 3/1992 Lee .
5,145,107 9/1992 Silver et al. .

*Primary Examiner*—Johnny D. Cherry
*Attorney, Agent, or Firm*—Kolisch, Hartwell, Dickinson, McCormack & Heuser

[57] ABSTRACT

A cup holder is disclosed in the form of a sheet with distal ends. A web is formed in one of the ends, and a corresponding slot is formed in the other end such that the ends interlock. Thus the cup holder is assembled by rolling the sheet and interlocking the ends. The sheet can be an elongate band of pressed material, preferably pressed paper pulp, and is preferably formed with multiple nubbins and depressions. In one embodiment, the sheet has a top and bottom that are arcuate and concentric, and matching webs and cuts are formed in each end of the sheet, with the cuts being perpendicular to the top of the sheet.

6 Claims, 1 Drawing Sheet

CUP HOLDER

FIELD OF THE INVENTION

The present invention relates generally to holders for cups. More particularly, the invention relates to a disposable cup holder that can be stored flat and then assembled by a user to fit around a cup. The resulting cup and holder combination increases the gripability and insulation value of the cup.

BACKGROUND ART

A cup holder is a removable device that encompasses a cup to provide added features to the cup. These features can include gripability, insulation value, and decoration. By gripability it is meant that the cup and holder combination is easier to hold in a human hand. Insulation value is important if the cup is holding hot or cold liquids, particularly if the cup is a thin disposable paper cup which has little inherent insulation value. Decoration can include features that make the cup more appealing, such as texture or color, or features that communicate to the user of the holder, such as advertising or instructions.

A conventional cup holder includes a three-dimensional body into which the cup is inserted. These bodies can be in the shape of an annular ring, such as that shown in U.S. Pat. No. 2,028,566, or in the shape of a cup that is oversized relative to the cup to be held, such as that shown in U.S. Pat. No. 2,617,549. In order to provide insulation value from a material that is thermally conductive, such as paper, the cup holders are usually provided with annular grooves or vertical flutes so that the holder is only in contact with the cup at the valleys in the grooves or flutes. These grooves or flutes provide a structural integrity to the cup holders such that they must be packaged in substantially the same form as they will be used. Thus a significant volume is required to store a quantity of the cup holders. Therefore it is cumbersome for a retailer selling drinks in cups to use the cup holders because a significant amount of shelf space is required just to have a sufficient quantity of cup holders accessible for immediate use.

It is an object of the invention to reduce the volume required to store cup holders.

Conventional cup holders may also require significant amounts of handling and operations to be assembled. It is a further object of this invention to reduce the number of steps involved in making a cup holder ready for ultimate use by the consumer.

An object of the invention is to produce a cup holder by bending a sheet and interlocking the ends.

It is a further object of the invention to improve the gripability of a cup.

Yet another object of the invention is to thermally insulate the hand of a user from the liquid held in a cup.

Another object of the invention is to form a cup holder from a substantially fiat sheet of pressed paper pulp.

SUMMARY OF THE INVENTION

The invented cup holder is designed for use with an upright cup. The cup is in turn designed for holding hot or cold liquids, and has an open rim and closed base.

The invented cup holder is formed from a sheet of flat material, preferably pressed paper pulp. The sheet is formed to have a length defined by a first end and a second end. The sheet has a width defined by a top and a bottom. Two cuts are made in the sheet, the first cut extending partially across the width of the sheet and adjacent one end. The second cut also extends partially across the width of the sheet, but is adjacent the end of the sheet opposite from the first cut. Preferably, one of the cuts severs the top of the sheet and the other of the cuts severs the bottom of the sheet. A holder conforming to a cup can then be made by rolling the sheet into a substantially cylindrical shape and interlocking the first end with the second end by interlocking the first cut with the second cut. Once the cylindrically shaped cup holder is made, a cup can be inserted into the cup holder.

The sheet includes a texture to increase the gripability and insulation value of the cup holder. In one embodiment, the texture includes multiple nubbins and depressions interspersed about the sheet, preferably in a uniform repeating geometrical pattern. The depressions can be aligned in rows forming troughs, so that any liquid that should spill on the cup holder will tend to trickle along the troughs.

If the cup holder is to hold a tapered cup, the holder fits the cup better if the top and bottom of the sheet are arcuate and essentially concentric. Preferably, the first cut is substantially non-parallel to the second cut such that the first cut and the second cut extend along lines that are substantially perpendicular to the arcuate top. When a sheet so formed is made into a cup holder, the resulting holder is tapered with a top and bottom that define planes essentially parallel to the planes defined by the rim and base of the cup to be held. The cuts will also be aligned with the taper of the cup when the holder is assembled, that is, the cuts will extend along a line that is substantially perpendicular to the above planes.

Alternatively, the present invention can be viewed as a combination of a cup and a cup holder. The cup holder is an elongate band having ends that detachably interlock. When the ends are so interlocked, the elongate band extends in a continuous loop. One method of interlocking the ends is by forming interlocking slots in the band. Preferably, the band includes a texture to increase the gripability and insulation value of the combination. The texture can include multiple nubbins and depressions interspersed about the band, preferably in a uniform repeating geometrical pattern. If the cup used as part of the combination is tapered, the tipper and lower surfaces of the band can be concentric arcuate shapes so that the continuous loop formed from the band is approximately conformed with the cup.

DETAILED DESCRIPTION AND BEST MODE OF CARRYING OUT THE INVENTION

Figure 1:
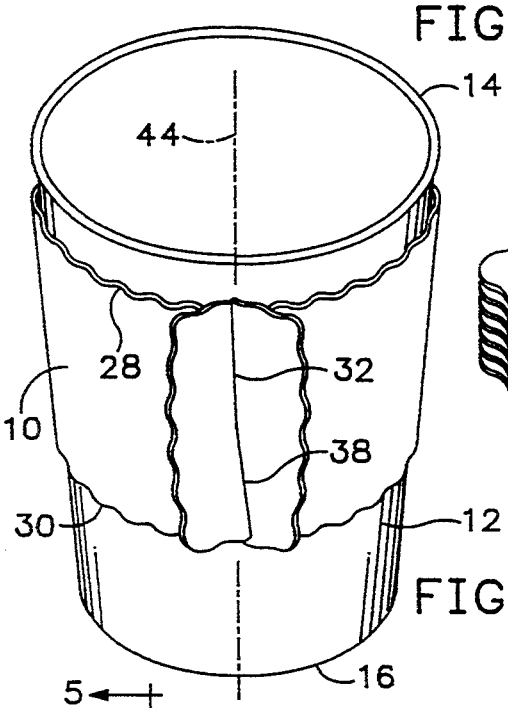
FIG. 1 is a perspective view of an assembled cup holder formed in accordance with one embodiment of the present invention, in combination with a cup.

Referring to FIG. 1, the cup holder 10 is shown in combination with a cup 12. Cup 12 is usually a tapered paper cup with an open rim 14 and a closed base 16. Cup holder 10 is shown in its assembled state in FIG. 1, and can be described as a continuous loop.

Figure 2:
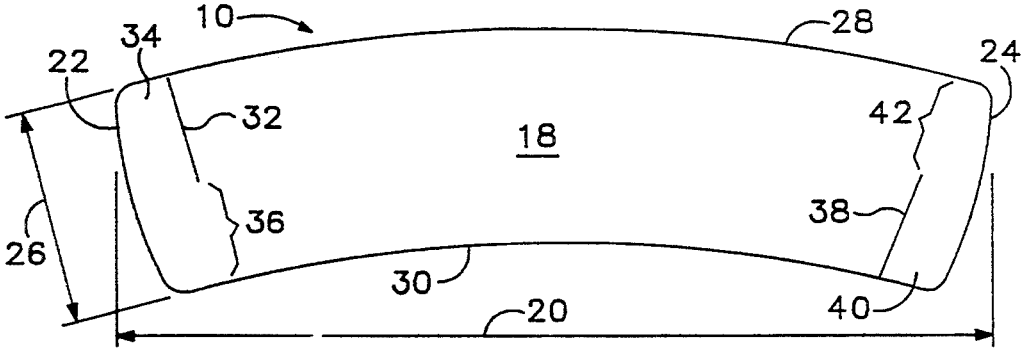
FIG. 2 is a top plan view of the cup holder of the present invention, shown unassembled.
Figure 3:
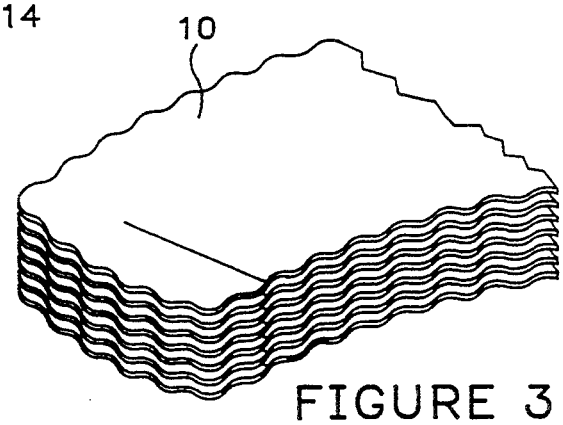
FIG. 3 is a perspective partial view of a stack of the cup holders shown in FIG. 2.

Cup holder 10 is shown unassembled in FIGS. 2 and 3, and is in the form of a sheet 18, also described as an elongate band having distal ends. Sheet 18 has a length 20 defined by a first end 22 and a second end 24. Sheet 18 also has a width 26, defined by a top 28 and a bottom 30. Top 28 and bottom 30 are preferably arcuate in shape. Thus top 28 can be described as an elongate arcuate surface and bottom 30 can also be described as an elongate arcuate surface. Elongate arcuate surface 28 is essentially concentric with elongate arcuate surface 30, such that the radius of surface 28 is longer than the radius of surface 30 by an amount approximately equal to width 26.

A first cut 32 is made in sheet 18 adjacent first end 22. First cut 32 extends partially across width 26, and preferably severs top 28 such that a first tab 34 and first web 36 are formed. A second cut 38 is made in sheet 18 adjacent second end 24. Second cut 38 extends partially across width 26, and preferably severs bottom 30 to form a second tab 40 and second web 42.

Figure 5:
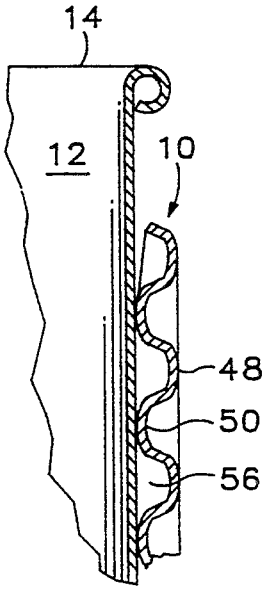
FIG. 5 is a partial front sectional view of the combination shown in FIG. 4, taken along the line 5—5 shown in FIG. 4.

When sheet 18 is configured as described above, a cup holder can be assembled as follows. Sheet 18 is rolled into a substantially cylindrical shape, and cuts 32 and 38 are interlocked with webs 42 and 36, respectively, thereby interlocking first end 22 with second end 24. The resulting cup holder forms a continuous loop as shown in FIG. 1, and can hold cup 12 by inserting cup 12 into cup holder 10. Elongate arcuate surface 28 forms an open annular top that is substantially parallel with rim 14 of cup 12. Elongate arcuate surface 30 forms an open annular bottom that is substantially parallel to base 16 of cup 12. Cup 12 extends through the open top and open bottom and, as shown in FIG. 5, encircles cup 12 so that cup holder 10 has an inner surface 58 and an outer surface 60. First cut 32 and second cut 38 extend along a line shown generally at 44. Line 44 is substantially perpendicular to rim 14 of cup 12. Alternatively, line 44 can be described as extending along the taper of cup 12.

Figure 4:
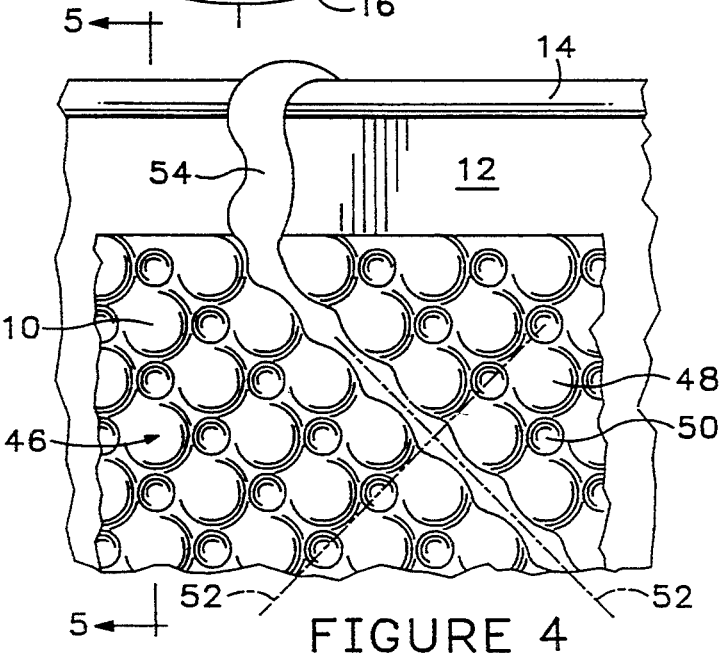
FIG. 4 is a partial :front elevation of the combination shown in FIG. 1, shown with liquid spilled on the cup holder.

As shown in FIGS. 4 and 5, sheet 18 is provided with a texture indicated generally at 46. Texture 46 includes multiple nubbins 48 and oppositely shaped discrete, approximately semi-spherically shaped depressions 50 distributed on substantially the entire inner surface 58 of sheet 18. Nubbins 48 and depressions 50 are arranged in a repeating geometrical pattern. Preferably, depressions 50 are aligned in rows forming troughs indicated generally by line 52 in FIG. 4.

Should liquid spill on cup holder 10, as indicated generally at 54 in FIG. 5, liquid 54 will tend to trickle along troughs 52. When the combination of cup holder 10 and cup 12 is held by a human hand, the hand will tend to be held away from troughs 52 by nubbins 48. Thus the hand will be kept out of contact with liquid 54. Furthermore, as shown in FIG. 4, when cup holder 10 is placed on an upright cup 12, troughs 52 extend along lines that intersect both rim 14 and lines extending along the taper of cup 12 at acute angles. Thus the flow of liquid 54 down cupholder 10 is slowed relative to the flow of liquid down vertically oriented flutes.

In addition, texture 46 provides an increased gripability to the cup and cup holder combination. Specifically, nubbins 48 provide a surface texture which is more easily held by a human hand.

Texture 46 also adds an insulation value to the combination because depressions 50 define non-contacting regions 56 of sheet 18, and thus reduce the surface contact between cup holder 10 and the hand of a user and cup 12, respectively. Thus conductive heat transfer is reduced. The insulation value is also increased by air gaps 56 formed by texture 46.

Furthermore, texture 46 is pleasing in appearance, and therefore provides decoration for cup holder 10.

Cup holder 10 as described above and shown in the figures is made from a reversible, two-sided sheet 18. That is, when sheet 18 is rolled to form a continuous loop, either of the textured sides can serve as the outside of cup holder 10. The reversibility of cup holder 10 is particularly evident when, as shown in FIG. 5, inner surface 58 and outer surface 60 are mirrored, that is, when each depression 62 on inner surface 58 defines a nubbine 48 on outer surface 60 and each depression 50 on outer surface 60 defines a nubbin 64 on inner surface 58. Non-reversible cup holders are, however, envisioned within the scope of the present invention.

Alternatively, the present invention can be viewed as a method of making a cup and cup holder combination. The method includes the steps of providing a flat sheet with a texture, forming the flat sheet into an elongate band 18 having a top elongate arcuate surface 28 and a bottom elongate arcuate surface 30. Elongate arcuate surface 28 is severed with a first cut 32 extending partially across elongate band 18. Elongate arcuate surface 30 is severed with a second cut 38 extending partially across elongate band 18. Elongate band 18 is then rolled to form a substantially cylindrical shape, and first cut 32 is interlocked with second cut 38 to form a continuous loop. A cup 12 is then inserted into cup holder 10.

Many materials are envisioned for use in making sheet 10, however pressed paper pulp is preferred. Pressed pulp, similar in properties to that used to make semi-rigid paper products such as egg cartons, is pleasing to the touch, partially absorbent, easily formed and relatively inexpensive.

INDUSTRIAL APPLICABILITY

The invented cup holder and cup and cup holder combination are applicable in any situation where the gripability, insulation value, or decoration of a cup needs to be augmented. It is particularly applicable for a cup holder for holding paper coffee cups.

While a preferred embodiment of the invented cup holder and cup and cup holder combination have been disclosed, changes and modifications can be made without departing from the spirit of the invention.

We claim:

1. A cup and holder combination comprising:

a cup for holding hot or cold liquids; and a holder defined by a band mounted on and encircling the cup, the band having an open top and an open bottom through which the cup extends and an inner surface immediately adjacent the cup with a plurality of discrete, spaced-apart, approximately semi-spherically shaped depressions distributed on substantially the entire inner surface of the band so that each depression defines a non-contacting region of the band creating an air gap between the band and the cup, thereby reducing the rate of heat transfer through the holder.

2. The cup and holder combination of claim 1, wherein the band also has an outer surface opposite the inner surface, with a plurality of discrete, spaced-apart, approximately semi-spherically shaped depressions distributed on substantially the entire outer surface of the band.

3. The cup and holder combination of claim 2, wherein the inner and outer surfaces of the band are mirrored, with each depression on the inner surface defining a nubbin on the outer surface and each depression on the outer surface defining a nubbin on the inner surface.

4. A holder for encircling a liquid-containing cup to reduce the rate of heat transfer between the liquid contained in the cup and a hand gripping the holder encircling the cup, comprising a band of material formed with an open top and an open bottom through which the cup can extend and an inner surface immediately adjacent the cup, the band including a plurality of discrete, spaced-apart, approximately semi-spherically shaped depressions distributed on substantially the entire inner surface of the band so that each depression defines a non-contacting region of the band creating an air gap between the band and the cup, thereby reducing the rate of heat transfer through the holder.

5. The holder of claim 4, wherein the band also has an outer surface opposite the inner surface, with a plurality of discrete, spaced-apart, approximately semi-spherically shaped depressions distributed on substantially the entire outer surface of the band.

6. The holder of claim 5, wherein the inner and outer surfaces of the band are mirrored, with each depression on the inner surface defining a nubbin on the outer surface and each depression on the outer surface defining a nubbin on the inner surface.

* * * * *